United States Patent [19]

Kamazawa

[11] Patent Number: 4,827,914

[45] Date of Patent: May 9, 1989

[54] MOTORIZED VIBRATOR WITH RECIPROCATING MOTION

[75] Inventor: Mitsuo Kamazawa, Tokyo, Japan

[73] Assignee: Keitatsu Co., Ltd., Tokyo, Japan

[21] Appl. No.: 169,015

[22] Filed: Mar. 16, 1988

[30] Foreign Application Priority Data

Feb. 18, 1988 [JP] Japan ..... 63-33981

[51] Int. Cl.[4] ..... A61H 1/00

[52] U.S. Cl. ..... 128/34; 128/35; 128/36; 128/41; 128/51; 128/55

[58] Field of Search ..... 128/34, 35, 36, 41, 128/42, 51, 52, 43, 55, 64, 56, 54

[56] References Cited

U.S. PATENT DOCUMENTS 3,710,785 1/1973 Hilger ..... 128/36

4,513,737 4/1985 Mabuchi ..... 128/52

*Primary Examiner*—Edgar S. Burr

*Assistant Examiner*—Kimberly Asher

*Attorney, Agent, or Firm*—Beveridge, DeGrandi & Weilacher

[57] ABSTRACT

A vibrator is used by pressing a vibrating member vibrated by the action of a driving source onto a shoulder or other parts of the body. A space is defined within the vibrating member, and an idler is movably disposed within the space. The idler may be composed of, for example, a solid cylindrical body, an elastically deformable cylindrical body, or a powdery or granular material.

12 Claims, 5 Drawing Sheets

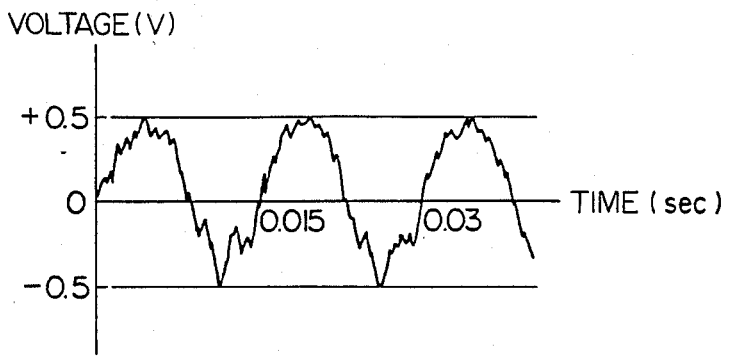
FIG. 7-A
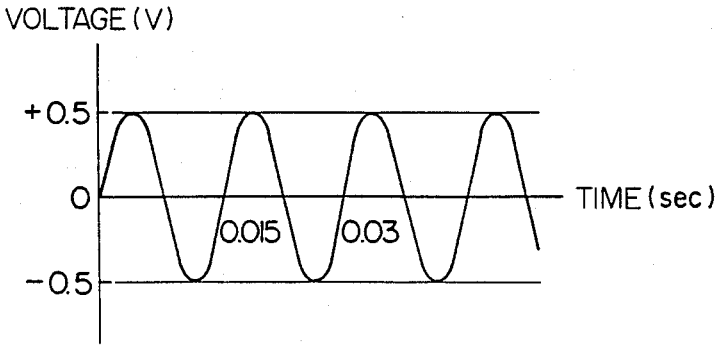
FIG. 7-B

MOTORIZED VIBRATOR WITH RECIPROCATING MOTION

FIELD OF THE INVENTION

This invention relates to a vibrator for massaging shoulders or other parts of the body.

DESCRIPTION OF THE PRIOR ART

Vibrators have been widely used for massaging a body part, for example shoulders. One example of such a vibrator is disclosed in Japanese Utility Model Publication No. 21588/1976. This vibrator comprises a housing having a gripping portion, a moving member reciprocally mounted on the housing, a driving source such as an electric motor for reciprocating the moving member, and a vibrating member attached to one end of the moving member. In operation, the vibrating member reciprocates via the moving member upon energization of the driving source, and thereby generates a striking force.

Since the vibrating member is merely attached to one end of the moving member, the conventional vibrator has the following disadvantages.

Firstly, the vibrator only makes a simple reciprocating motion, and a relatively deep striking force having a high massaging effect cannot be obtained.

Secondly, no heat is substantially generated in the vibrating member, and no hot effect can be expected at the time of massaging with the vibrator.

SUMMARY OF THE INVENTION

A primary object of this invention is to provide an excellent vibrator which can impart a relatively deep striking force by a simple structure.

Another object of this invention is to provide an excellent vibrator which can produce a hot effect by a simple structure.

Still another object of this invention is to provide an excellent vibrator with little occurrence of noises.

According to this invention, there is provided a vibrator provided with a vibrating member adapted to be vibrated by the action of a driving source, said vibrating member having a spaced provided therein and an idler disposed movably in said space.

BRIEF DESCRIPTION OF THE DRAWINGS

FIGS. 7-A and 7-B are views showing the wave forms detected in Example 1 and Comparative Example 1, respectively.

DETAILED DESCRIPTION OF THE PREFERRED EMBODIMENTS

The invention will now be described in more detail with reference to the accompanying drawings.

FIRST EMBODIMENT

Figure 1:
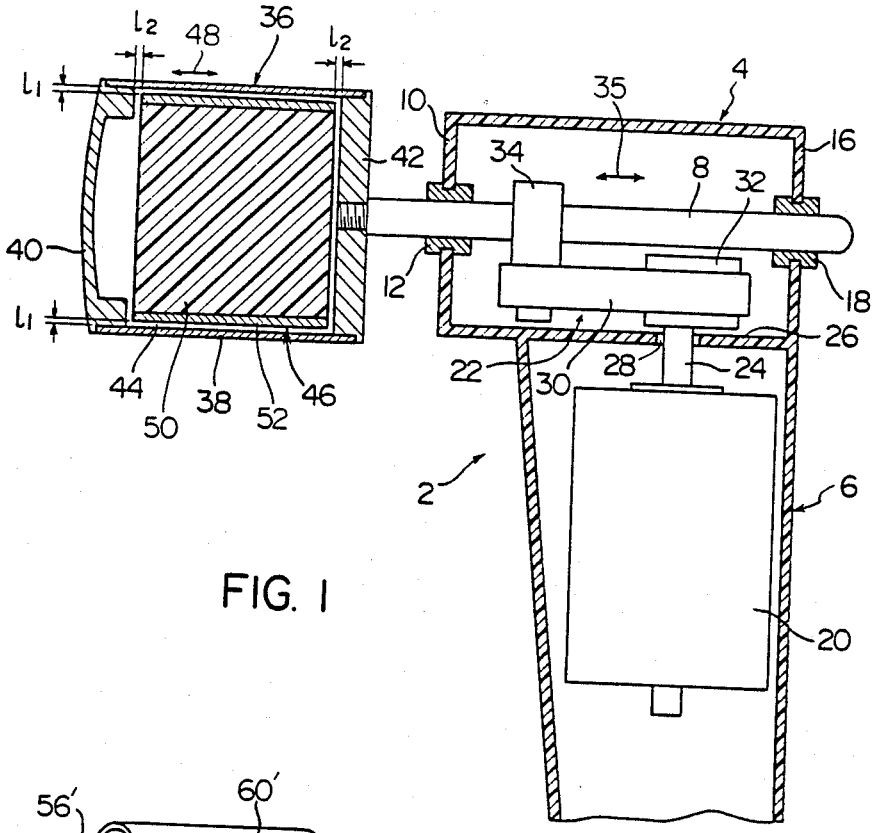
FIG. 1 is a sectional view showing the principal parts of a first embodiment of the vibrator made in accordance with this invention.

With reference to FIG. 1, the first embodiments of the invention will be described.

The illustrated vibrator is provided with a housing 2 which has a cylindrical main body portion 4 and a gripping portion 6 extending from the main body portion 4. The housing 2 may be formed of, for example, a synthetic resin material.

A moving member 8 is attached to the main body portion 4. The moving member 8 is formed of a rod-like material, and is moving supported at one end portion by one end wall 10 of the main body portion 4 via a sleeve member 12 and at the other end portion by another end wall 16 of the main body portion 4 via a sleeve member 18.

Within the gripping portion 16 is disposed an electric motor 20 constituting a driving source. A drive coupling mechanism shown at 22 is provided between the electric motor 20 and the moving member 8. The electric motor 20 has an output shaft 24 projecting into the main body portion 4 through an opening 28 formed in a side wall 26 in the main body portion 4. Drive coupling mechanism 22 has a crank member 30. A short cylindrical member 32 is rotatably mounted on one end portion (the right end portion in FIG. 1) of the crank member 30 via a bearing member (not shown). The output shaft 24 of the electric motor 20 is rotatably coupled to the short cylindrical member 32 eccentrically therewith. In the illustrated embodiment, the output shaft 24 of the electric motor 20 is coupled to the short cylindrical member 32 by forming a through-hole eccentrically in the short cylindrical member 32 and fitting the output shaft 24 rotatably in the through-hole. One end portion (the lower end portion in FIG. 1) of a linking member 34 is rotatably linked to the other end portion (the left end portion in FIG. 1) of the crank member 30, and the other end portion (the upper end portion in FIG. 1) of the linking member 34 is linked to the moving member 8. In the illustrated embodiment, the linking member 34 is linked to the moving member 8 by forming a through-hole in the other end portion of the linking member 34, fitting the moving member 8 in the through-hole, and fixing the linking member 34 and the moving member 8 to each other by using an adhesive or otherwise. Because of the foregoing structure, when the electric motor 20 is rotated in a predetermined direction, the moving member 8 is caused to reciprocate right-to-left in FIG. 1, namely in the direction shown by an arrow 35.

In the first embodiment, one end portion of the moving member 8 projects outwardly through the end wall 10 of the main body portion 4, and a vibrating member 36 is attached to this projecting end portion. The vibrating member 36 is comprised of a hollow cylindrical body consisting of a cylindrical sleeve member 38 defining a cylindrical side wall, a disc-like member 40 defining one end wall and a circular closure 42 defining the other end wall, which together define a cylindrical space 44. In the illustrated embodiment, the disc-like member 40 acts as a striking portion, and preferably, its outside surface is raised slightly as shown in FIG. 1. Preferably, the vibrating member 36 is made of a metallic material such as titanium as can be easily understood from the description given hereinafter. In the illustrated embodiment, an externally threaded portion is formed in one end portion of the moving member 8, and an internally threaded portion is formed in the closure 42 of the vibrating member 36. By fitting the externally threaded portion in the internally threaded portion of the vibrating member 36, the vibrating member 36 is fixed in position to the moving member 8.

In the vibrator in accordance with the first embodiment, an idler 46 is movably mounted within the space 44 defined in the vibrating member 36. The idler 46 in the first embodiment is cylindrical corresponding to the shape of the space 44. The cylindrical idler 46 is mounted within the space 44 so as to be free to move in the direction shown by an arrow 48 (i.e., right-to-left in FIG. 1). The difference ($2l_1$) between the outside diameter of the idler 46 and the inside diameter of the cylindrical sleeve member 38 of the vibrating member 36 is preferably about 0.5 to 3.0 mm. If this difference is made larger, smooth reciprocating movement of the idler 46 in the direction shown by the arrow 48 becomes substantially difficult. The moving distance of the idler 46 in the direction of the arrow 48, i.e. the distance ($2l_2$) between the two end surfaces and the inside surfaces of the disc-like member 40 and the closure 42, is preferably about 0.3 to 15 mmm. If this distance is made larger, the impact imparted to the disc-like member 40 and the closure 42 by the reciprocating movement of the idler 46 becomes greater, and the vibrating member 36 is likely to be broken. The idler 46 is preferably made of a metallic material such as stainless steel in at least its peripheral surface. In the illustrated embodiment, the main body 50 of the idler is formed from an expoxy resin. and its peripheral surface is covered with a plate 52 of stainless steel.

In operation, when the electric motor 20 is energized and rotated in a predetermined direction, the moving member 8 is accordingly reciprocated in the direction shown by the arrow 35 as stated hereinabove. Consequently, the vibrating member 36 also reciprocates in the direction of arrow 35 as a unit with the moving member 8. Since the moving member 8 is disposed movably in the space 44, the reciprocating movement of the vibrating member 36 causes the idler 46 to reciprocate in the direction of arrow 48 within the space 44 and to abut with the disc-like member 40 and the closure 42 of the vibrating member 36. As a result, an impact force is applied to the vibrating member 36. Thus, the vibrating member 36 vibrates complexly by the reciprocating of the moving member 8 in the direction of arrow 14 and the reciprocating of the idler 46 in the direction of arrow 48 in the space 44. Its vibration is therefore composed of the vibration imparted by the reciprocation of the moving member 8 in the direction of arrow 14 and the vibration imparted by the reciprocation of the idler 46 in the direction of arrow 48, and is stronger than one imparted by simple reciprocation of the vibrating member 36. By pressing the disc-like member 40 to a shoulder or other parts of the body, a relatively deep striking force of high massaging effect can be obtained. Furthermore, as a result of reciprocation of the idler 46 within the space 44 of the vibrating member 36, heat is generated by friction between the vibrating member 36 and the idler 46 and warms the vibrating member 36. Accordingly, a hot effect on the body part can be obtained by the warmed vibrating member 36 without using a heater or the like. This effect can be obtained efficiently by forming the contacting surfaces of the vibrating member 36 and the idler 46 from a metallic material. In the illustrated embodiment, when the idler 46 moves in the direction of arrow 48, it rotates while being in contact with the inside surface of the vibrating member 36 defining the space 44. Hence, the heat of friction is generated effectively between the vibrating member 36 and the idler 46, and a relatively deep striking force is obtained upon collision of the idler 46 with the vibrating member 36.

Figure 2:
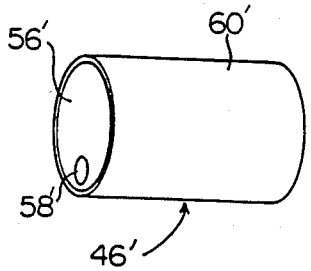
FIG. 2 is a perspective view showing a modified example of an idler in the vibrator of FIG. 1.

To promote the rotational motion of the idler 46 described above, the idler 46 is preferably made as shown in FIG. 2. In FIG. 2, the illustrated idler 46' has a cylindrical main body 56' made of a synthetic resin material such as an epoxy resin. An eccentric weight 58' extending axially and eccentrically with the central axis of the main body 56' is disposed in the main body 56', and the peripheral surface of the main body 56' is covered with a relatively thin sheet-like material 60' formed of stainless steel. The eccentric weight 58' may be formed of a metallic material having a high specific gravity such as lead.

The center of gravity of the idler 46' so constructed deviates toward the eccentric weight 58' from the central axis. When this idler 46' is used, a relatively large rotational force is generated in the idler 46' at the time of reciprocating movement, and thus rotates the idler 46' in a predetermined direction. This rotation causes the idler 46' to move in a definite direction. As a result, the reciprocation of the idler is stabilized more and a deeper striking force can be obtained.

Instead of providing the eccentric weight, a through-hole extending in the axial direction may be formed eccentrically. In this case, the center of gravity of the idler deviates toward that side which is opposite to that side in which the through-hole is formed.

A permanent magnet may be fixed to the idler so as to move reciprocately as a unit.

SECOND EMBODIMENT

Figure 3:
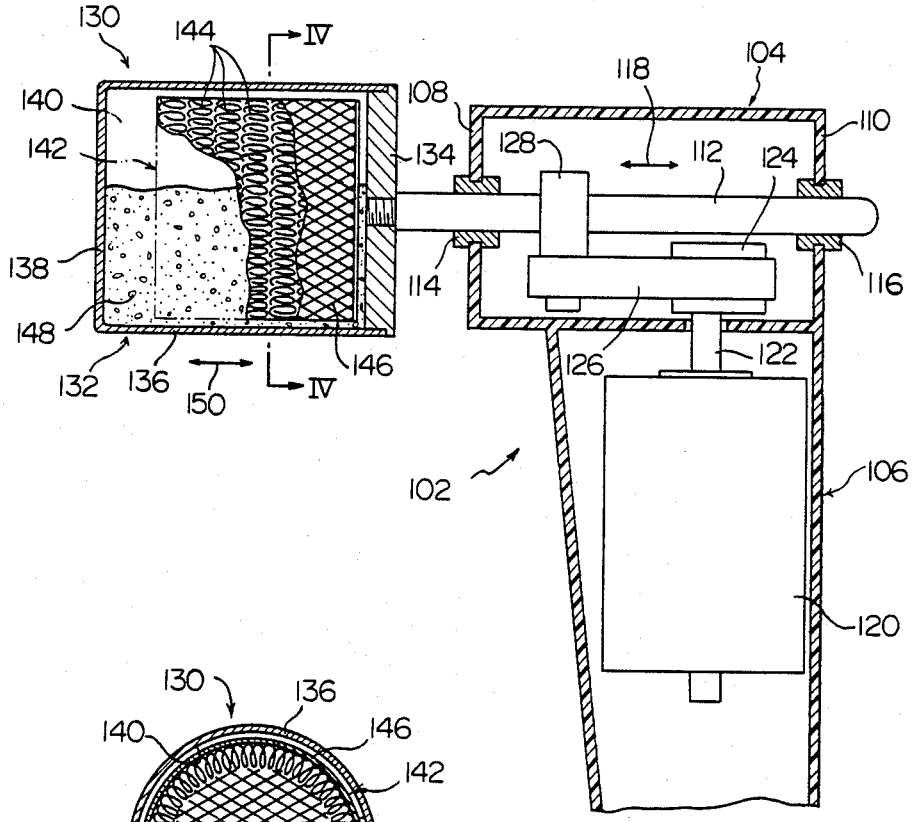
FIG. 3 is a sectional view showing principal parts of a second embodiment of the vibrator made in accordance with this invention.
Figure 4:
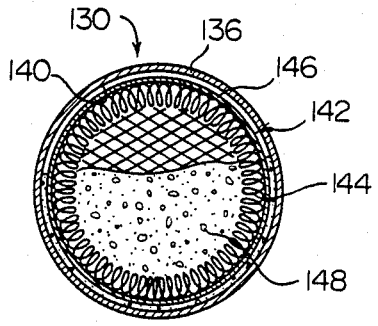
FIG. 4 is a sectional view taken along line IV—IV of FIG. 3.

FIGS. 3 and 4 show a second embodiment of the vibrator in accordance with this invention. The vibrator illustrated in FIG. 3 is provided with a housing 102 consisting of a main body portion 104 and a gripping portion 106. A moving member 112 is supported across end walls 108 and 110 of the main body portion 104 via sleeve members 114 and 116 in such a manner that it is free to move in the direction shown by an arrow 118. An electric motor 120 is disposed in the gripping portion 106, and its output shaft 122 is drivingly connected to the moving member 112 via a short cylindrical member 124, a crank member 126 and a linking member 128. The above structure is substantially the same as that of the first embodiment, and when the electric motor 120 is energized, the moving member 112 makes a reciprocating motion in the direction shown by an arrow 118.

In the second embodiment, too, one end portion of the moving member 112 projects outwardly through the end wall 108 of the main body portion 104, and a vibrating member 130 is attached to this projecting end portion. The illustrated vibrating member 130 has a casing 132 and a closure 134. The casing 132 has a cylindrical side wall 136 and an end wall 138 provided at one end of the side wall 136 with the other end of the side wall 136 being open. The closure 134 is made of a disc-like material and fixed to the other open end of the casing 132. It will be seen from FIG. 3 that the end wall 138 of the casing 132 acts as a striking portion, and the casing 132 and the closure 134 define a cylindrical space 140. The casing 132 and the closure 134 may be formed of a metallic material such as titanium. The vibrating member 130 is attached to one end of the moving member 112 by fitting an externally threaded portion formed at one end portion of the moving member 112 in an internally threaded portion formed in the closure 136.

In the second embodiment, an idler having elasticity is disposed movably within the cylindrical space 140 defined in the vibrating member 130. As shown in FIGS. 3 and 4, the idler is made of an elastic hollow cylindrical body 142 formed by wrapping a coil material. The elastic hollow cylindrical body 142 may be made by, for example, wrapping relatively short coil materials in circular form and connecting the opposite end portions of each coil material to thereby form a plurality of (seven in the drawing) ring-like members 144, laying the ring-like members 144 and connecting them to each other. The elastic hollow cylidrical body 142 may also be formed by wrapping relatively long coil materials helically. The coil materials may be copper wires optionally jacketed with a protective layer of a synthetic resin such as polyurethane.

Preferably, the outside surface of the elastic hollow cylindrical body 142 is covered with a mesh member 46. The mesh member 146 which can be formed, for example, by connecting wires in lattice form covers substantially the entire elastic hollow cylindrical body 142, namely its peripheral side surface and both end portions, to prevent separation of the laid ring-like members 144. It is not necessary for the mesh member 146 to cover substantially the entire elastic hollow cylindrical body 142. It may be any suitable form which prevents separation of the ring-like members 144. The mesh member 146 may be formed of a metallic material such as stainless steel. Because of the metallic material, the mesh member 146 can be deformed as will be stated below. If the elastic hollow cylindrical member 142 deforms comparatively greatly, or separation of the ring-like members 144 or another inconvenience does not occur, the mesh member 146 may be omitted.

In the illustrated embodiment, a powdery or granular material 148 is enclosed movably in the cylindrical space 140 defined in the vibrating member 130. The powdery or granular material 148 may be formed of, for example, a metallic material such as gold, silver, copper, iron, silicon, germanium and niobium, a material coated with such a metallic material, activated carbon, or ceramics. Preferably, the material 148 is free to move through the spaces existing in the elastic hollow cylindrical body 142 and the mesh member 146.

When the vibrating member 130 is reciprocated in the direction of arrow 118 as a unit with the moving member 112 in this vibrator, the elastic hollow cylindrical body 142 and the powdery or granular material 148 are moved substantially in the direction shown by an arrow 150 within the cylindrical space 140. Consequently, the vibrating member 130, particularly its end wall 138, vibrates completely. By pressing the end wall 138 relatively weakly against a shoulder or another part of the body, a moderately deep striking force can be obtained. When the elastic cylindrical member 142 and the powdery or granular material 148 move within the cylindrical space 140, the resultant friction between the mesh member 146 covering the elastic hollow cylindrical body 142 and the inside surface of the vibrating member 130 and between the powdery or granular material 148 and the inside surface of the vibrating member 130 produces heat. Moreover, since the powdery or granular material 148 can freely move through the elastic hollow cylindrical body 142 and the mesh member 146, heat is also generated by friction and collision between the powdery or granular material 148 and the elastic hollow cylindrical body 142 and the mesh member 146, and collision between the particles of the material 148. The heat so generated warms the vibrating member 130, and a hot effect on the body part may be obtained without using a particular heating means such as an electric heater. The hot effect can be efficiently obtained by forming the vibrating member 130 and the elastic hollow cylindrical body 142 from a metallic material. In the second embodiment, too, when the elastic hollow cylindrical body 142 moves in the direction of arrow 150, it rotates while being in contact with the inside surface of the vibrating member 130 defining the cylindrical space 140. Hence, the heat of friction is effectively generated between the elastic hollow cylindrical body 142 and the vibrating member 130, and a relatively deep striking force is obtained when the elastic cylindrical body 142 collides with the end wall 138. In addition, since the elastic cylindrical body 142 has elasticity and is covered with the mesh member 146, the elastic cylindrical body 142 and the mesh member 146 are slightly deformed elastically. This elastic deformation cushions the shock at the time of collision. Accordingly, since the striking force of the vibrator is slightly lower than that of the first embodiment, the occurrence of noises from impact, vibration, etc. is markedly reduced. Furthermore, since the mass of the powdery or granular material 148 is small, the shock of collision of the powdery or granular material 148 with the vibrating member 130, the hollow cylindrical body 142 and the mesh member 146 is small, and no great noises are caused by the movement of the powdery or granular material 148.

In order to move the elastic cylindrical member 142 smoothly as stated above, the difference between the outside diameter of the elastic cylindrical body 142 (the mesh member 146 when the elastic cylindrical body 142 is covered with it) and the inside diameter of the side wall 136 of the vibrating member 130 is preferably set at about 0.5 to 3.0 mm. If this difference is large, the distance over which the elastic hollow cylindrical member 142 moves in a direction perpendicular to the direction of arrow 150 increases, and the elastic hollow cylindrical body 142 becomes difficult of smooth reciprocation. To reduce noises and obtain a moderate stroking force and the desired amount of heat generated, the moving distance of the elastic hollow cylindrical body 142 in the direction of arrow 150 (in other words, the difference between the height of the elastic cylindrical body 142 and the distance between the end wall 138 and the closure 134 in the vibrating member 130) is preferably set at about 5 to 30 mm. If this moving distance is larger, the impact of the elastic hollow cylindrical body 142 and the noises become larger. In the first embodiment, the idler cannot be moved over a larger distance because it is solid and has a large mass. In the second embodiment, the moving distance of the idler can be made larger than in the first embodiment since the elastic hollow cylindrical body 142 is formed of coil materials. The amount of the powdery or granular material 148 enclosed within the cylindrical space 140 is preferably about 30 to 80% of the total volume of the space 140. If its amount is increased, the aforesaid reciprocating movement of the elastic hollow cylindrical body 142 is impaired.

THIRD EMBODIMENT

Figure 5:
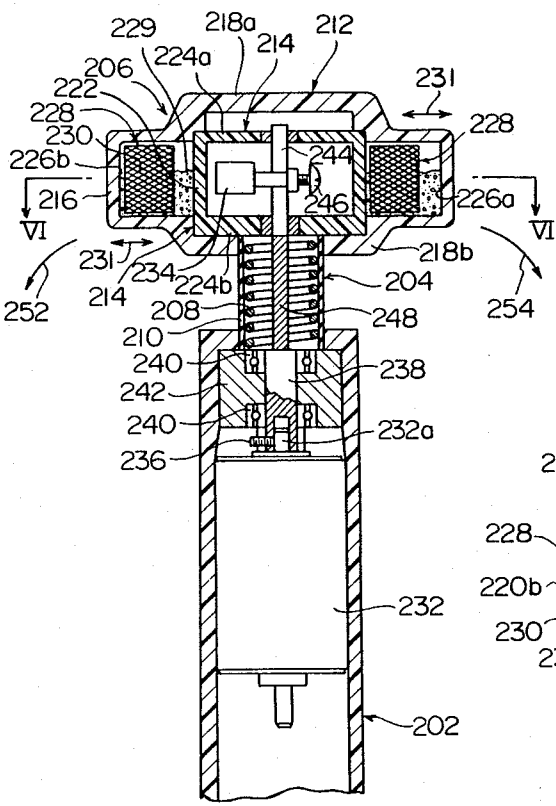
FIG. 5 is a sectional view showing the principal parts of a third embodiment of the vibrator made in accordance with this invention.
Figure 6:
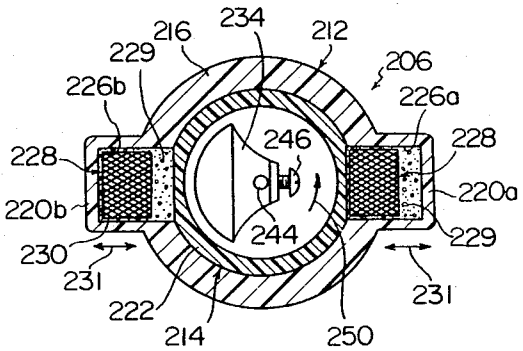
FIG. 6 is a sectional view taken along line IV—IV of FIG. 5.

FIGS. 5 and 6 show a third embodiment of the vibrator of this invention.

In the first and second embodiments, the vibrating member is vibrated by the action of the moving member which is reciprocated by the driving source. In the third embodiment, the vibrating member is vibrated by the action of a driving eccentric weight to be revolved by a driving source.

In FIGS. 5 and 6, the illustrated vibrator has a cylindrical housing 202 which also acts as a gripping portion for the operator to hold. Supporting means 204, which are elastically deformable in any direction, is attached to one end (the upper end in FIG. 5) of the housing 202, and a vibrating member 206 is secured to the supporting means 204. The supporting means 204 is comprised of a coil spring 208 and a protective sleeve 210 covering the coil spring 208. The coil spring 208 and the protective sleeve 210 are secured at one end to the housing 202 and at the other end of the vibrating member 206. The protective sleeve 210 may be formed, for example, of a rubber material or a synthetic resin material.

The illustrated vibrating member 206 is comprised of an outside member 212 and an inside member 214. The outside member 212 has a sleeve-like circumferential side wall 216 and end walls 218a and 218*b* provided at both ends of the peripheral side wall 216 and is hollow inside. Radially outwardly extending protrusions 220*a* and 220*b* are provided at opposing sites of the circumferential side wall. These protrusions 220*a* and 220*b* act as a striking portion. The inside member 214 has a sleeve-like circumferential side wall 222 and ends walls 224*a* and 224*b* provided at both ends of the circumferential side wall 222, and is hollow inside. As shown in FIGS. 5 and 6, the inside member 214 is fitted in the inside of the outside member 212 to define two spaces 226*a* and 226*b* in the vibrating member 204. The space 226*a* is defined by the inside surface of the protrusion 220*a* of the outside member 212 and the circumferential side wall 222 of the inside member 214, and the space 226*b*, by the protrusion 220*b* of the outside member 212 and the circumferential side wall 222 of the inside member 214. In each of the spaces 226*a* and 226*b*, an elastic hollow cylindrical body 228 and a powdery or granular material 229 are disposed movably. The elastic hollow cylindrical body 228 is covered with a mesh member 230, and the powdery or granular material 229 is enclosed so as to be free to move through the elastic hollow cylindrical body 228 and the mesh member 230. The outside member 212 and the inside member 214 respectively define the cylindrical spaces 226*a* and 226*b*, and in correspondence to it, the elastic hollow cylindrical body 228 formed of a coil member is disposed so as to be free to move within the spaces 226*a* and 226*b* in the direction shown by an arrow 231. The outside member 212, the inside member 214 and the housing 202 are formed of a synthetic resin material.

An electric motor 232 constituting a driving source for vibrating the vibrating member 206 is disposed within the housing 202, and a vibrating eccentric weight 234 is disposed in the vibrating member 206. The eccentric weight 234 is adapted to revolve by the action of the electric motor 232. The output shaft 232*a* of the electric motor 232 is linked to a linking rod 238 by means of a setscrew 236. The linking shaft 238 is rotatably supported by a supporting block 242 via a pair of bearings 240. The supporting block 242 is mounted in one end portion of the housing 202. The eccentric weight 234 which is nearly fan-shaped is provide in a space within the inside member 214, and its based portion is fixed by a setscrew 246 to a rotating shaft 244 rotatably supported across the end walls 224*a* and 224*b* of the inside member 214. The linking shaft 238 in the housing 202 and the rotating shaft 244 in the vibrating member 206 are drivingly linked via linking means 248 such as a spring shaft elastically deformable in any direction.

When the electric motor 232 is energized in the vibrator of the third embodiment, the eccentric weight 234 is rotated, for example, in the direction shown by an arrow 250 (FIG. 6) via the linking shaft 238, the linking means 248 and the rotating shaft 244. As a result, a force tending to vibrate the vibrating member 206 mainly in the directions shown by arrows 252 and 254 is generated because the eccentric weight 234 exists eccentrically with respect to the central axis of the rotating shaft 244 and the elastic hollow cylindrical bodies 228 are disposed opposite to each other within the vibrating member 206. Accordingly, the vibrating member 206 is reciprocated in the directions of arrows 252 and 254. This reciprocating movement of the vibrating member 206 causes the elastic hollow cylindrical bodies 228 and the powdery or granular materials 229 to reciprocate in the direction of arrow 231 within the spaces 226*a* and 226*b*. Accordingly, substantially as in the second embodiment, the movement of the elastic hollow cylindrical bodies 228 and the powdery or granular materials 229 imparts a moderately deep striking force and a hot effect to that part of the body which is massaged.

MODIFICATIONS

The vibrator of the invention is not limited to the various specific embodiments described hereinabove, and can be applied to other various types of vibrators in which the vibrating member is reciprocated by other mechanisms.

For example, in the first and second embodiments, the vibrating member is provided at one end portion of the moving member. It is possible, however, to provide another vibrating member at its other end portion.

In the second and third embodiments, both the elastic hollow cylindrical body and the powdery or granular material are disposed within a space defined in the vibrating member so that they are free to move. This arrangement is not limitative, and by simply disposing the elastic hollow cylindrical body alone within the above space of the vibrator, the desired effect may be achieved. The desired effect may also be achieved by using only the powdery or granular material as the idler.

The following Examples and Comparative Example illustrate the present invention more specifically.

EXAMPLE 1

A vibrator of the type according to the first embodiment shown in FIG. 1 was used, and the vibrating state of the vibrating member was measured. The main parts of the vibrator had the following specifications.

Outside diameter of the vibrating member: 43 mm
Inside diameter of the vibrating member: 41 mm
Outside diameter of the idler: 40 mm
Length of the idler: 30 mm
Amount of movement ($2l_2$) of the idler in the axial direction: 1 mm Amount of movement ($2l_1$) of the idler in the radial direction: 1 mm The measurement was done by the following procedure.

A permanent magnet was placed on relatively soft sponge, and a detection coil was disposed covering the parmanent magnet. The vibrating member of the vibrator was positioned within the detection coil. The electric motor of the vibrator was energized to vibrate the vibrating member, and the permanent magnet was moved by the vibrating member. The permanent magnet and the detection coil used had the following specifications.

Permanent magnet: cylindrical with a diameter of 5 mm and a thickness of 3 mm

Magnetic flux density of the magnet: 3000 gauss

Length of the detection coil: 12 mm

Inside diameter of the detection coil: 50 mm

Number of windings of the detection coil: 50

In the measurement, the electric motor was rotated at 4,000 rpm, and the vibrating member was reciprocated with a stroke of 8 mm.

By vibrating the vibrating member, the permanent magnet moved within the detection coil, and a voltage was generated in the detection coil. The voltage in the detection coil was detected by a voltage detector. The detected voltage was amplified and displayed on an oscilloscope. As a results, the detected wave form shown in FIG. 7-A was obtained.

The detected wave form shown in FIG. 7-A substantially corresponds to the positional relation of the permanent magnet. Hence, FIG. 7-A shows that the vibrating member of the above vibrator vibrated complexly.

COMPARATIVE EXAMPLE 1

Example 1 was repeated except that the idler was fixed within the vibrating member to make it impossible of movement. The detected wave form is shown in FIG. 7-B.

FIG. 7-B shows that the vibrator used in this comparison vibrated monotonously.

EXAMPLE 2

A vibrator of the type according to the second embodiment shown in FIGS. 3 and 4 was used, and the state of heat generation in the vibrating member was measured. The main parts of the vibrator had the following sizes.

Casing

Outside diameter: 36 mm

Inside diameter: 34 mm

Length: 43 mm

Closure

Outside diameter: 36 mm

Thickness: 7 mm

Elastic hollow cylindrical body

Outside diameter: 32 mm

Inside diameter: 24 mm

Height: 28 mm (The hollow cylindrical body was made by stacking seven ring-like members each having a thickness of 4 mm.)

Mesh member

Outside diameter: 33 mm

Inside diameter: 32 mm

Height: 29 mm

The casing and the closure were formed of titanium, and the mesh member, of stainless steel. Each of the coil members forming the elastic hollow cylidrical body was made by bundling three copper wires having a diameter of 0.5 mm and applying a polyurethane protective coating to the bundle. The powdery or granular material was a mixture of copper particles (mesh #100) and granular activated carbon in a volume ratio of 1:4. The powdery or granular material was enclosed in a space defined in the vibrating member in an amount of about 50% of the total volume of the space.

In the measurement, the vibrating member was vibrated at 63 Hz. The stroke of the vibrating member was 5 mm, and the movable distance of the elastic hollow cylindrical body was 9 mm. The temperature of the room at the time of experiment was 25° C. In the temperature measurement, a digital recorder (commercially available under the tradename TR-2721A from K.K. ADVANTEST) was used. The temperature measure of the digital recorder was attached to the end surface (acting as a striking portion) of the vibrating member by means of a tape. After the driving source was energized, the relation between the time and the temperature was measured.

The temperature was measured every minute until 20 minutes passed from the energization of the driving source. The results of the measurement is shown in FIG. 8.

Figure 8:
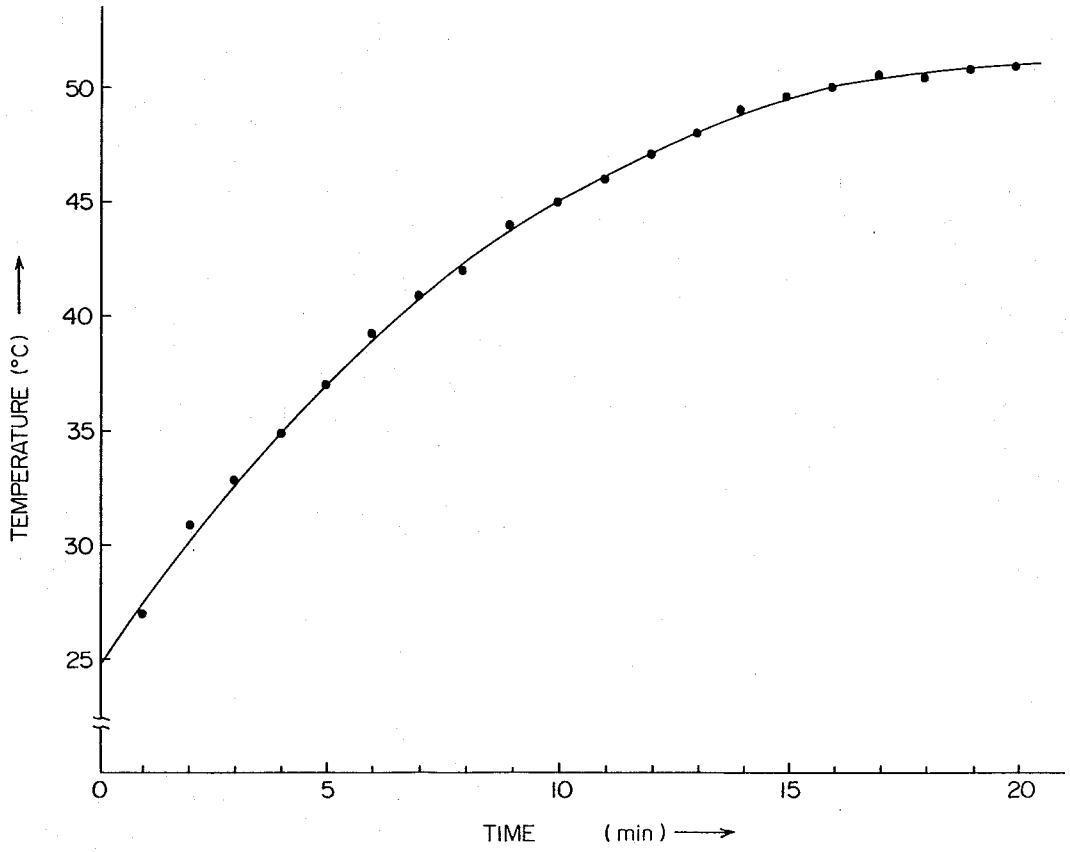
FIG. 8 is a view showing the relation between time and temperature obtained in Example 2.

FIG. 8 shows that the temperature of the vibrating member abruptly rose within a relatively short period of time. Thus, by lightly pressing the vibrating member onto the shoulder, a hot effect was obtained together with a moderate striking force.

What is claimed is:

1. A vibrator, comprising:

a vibrating member adapted to be vibrated by the action of a driving source, said vibrating member including a body with a peripheral surface and end surfaces defining a space;

an idler freely disposed in the space so as to be free to move within the space in response to movement of the body, said idler being in contact with said peripheral surface, and said idler being free to move into and out of contact with said end surfaces.

2. The vibrator of claim 1 wherein the idler is composed of a solid cylinrical body.

3. The vibrator of claim 2 wherein the center of gravity of the idler is eccentric with respect to the central axis substantially parallel to the moving direction of the idler.

4. The vibrator of claim 3 wherein an eccentric weight deviated from the central axis is provided in the idler.

5. The vibrator of claim 1 wherein the idler is composed of an elastic cylindrical body which can be deformed elastically.

6. The vibrator of claim 5 wherein the elastic cylindrical body is comprised of a wound coil.

7. The vibrator of claim 6 wherein the elastic cylindrical body includes a mesh member which prevents extensive deformation of said wound coil.

8. The vibrator of claim 6 further comprising a powdery or grandular material movably disposed in the space.

9. The vibrator of claim 8 wherein the powdery or granular material is a mixture of copper particles and activated carbon.

10. The vibrator of claim 1 wherein the idler is composed of a powdery or granular material.

11. The vibrator of claim 10 wherein the powdery or granular material is a mixture of copper particles and activated carbon.

12. The vibrator of claim 1 wherein said idler is freely movable in an axial direction.

* * * * *